US006731773B1

(12) United States Patent
Bergbower et al.

(10) Patent No.: US 6,731,773 B1
(45) Date of Patent: May 4, 2004

(54) DUAL BASKET SPEAKER WITH REPLACEABLE, SELF-ALIGNING CONE ASSEMBLY AND SUPER VENTILATED POLE PIECE

(75) Inventors: Chanc L. Bergbower, Stillwater, OK (US); Zhijun Zhao, Stillwater, OK (US)

(73) Assignee: Stillwater Designs and Audio, Inc., Stillwater, OK (US)

( * ) Notice: Subject to any disclaimer, the term of this patent is extended or adjusted under 35 U.S.C. 154(b) by 0 days.

(21) Appl. No.: 10/286,431

(22) Filed: Nov. 1, 2002

(51) Int. Cl.[7] ..... H04R 25/00

(52) U.S. Cl. ..... 381/397; 381/420; 381/432; 381/433

(58) Field of Search ..... 381/396, 397, 381/403, 404, 407, 412, 420, 432, 433, 182, 186; 181/144, 145, 147, 199; 29/594, 609.1

(56) References Cited

U.S. PATENT DOCUMENTS

| | | | | | |
|---|---|---|---|---|---|
| 2,295,483 | A | * | 9/1942 | Knowles | 381/404 |
| 2,426,948 | A | | 9/1947 | Preston | |
| 2,534,040 | A | | 12/1950 | Lindley | |
| 2,539,672 | A | | 1/1951 | Olson et al. | |
| 3,462,559 | A | | 8/1969 | Wilder | |
| 3,796,839 | A | | 3/1974 | Torn | |
| 4,234,766 | A | | 11/1980 | Cacho | |
| 4,256,930 | A | | 3/1981 | Garner et al. | |
| 4,297,537 | A | | 10/1981 | Babb | |
| 4,357,498 | A | | 11/1982 | Tsuchiya et al. | |
| 4,508,941 | A | | 4/1985 | Wiggins | |
| 4,565,905 | A | | 1/1986 | Nation | |
| 5,040,221 | A | | 8/1991 | Edwards et al. | |
| 5,081,684 | A | | 1/1992 | House | |
| 5,357,586 | A | * | 10/1994 | Nordschow et al. | 381/397 |
| 5,602,930 | A | | 2/1997 | Walton | |
| 5,625,701 | A | | 4/1997 | Scanlan | |
| 5,739,480 | A | | 4/1998 | Lin | |
| 6,095,278 | A | | 8/2000 | Lin | |
| 6,111,969 | A | | 8/2000 | Babb | |
| 6,243,479 | B1 | | 6/2001 | Proni | |
| 6,327,371 | B1 | | 12/2001 | Proni | |
| 6,390,231 | B1 | | 5/2002 | Howze | |
| 6,430,300 | B1 | | 8/2002 | Cox et al. | |
| 6,510,232 | B2 | | 1/2003 | Frasl | |
| 6,639,993 | B2 | * | 10/2003 | Kemmerer et al. | 381/397 |

OTHER PUBLICATIONS

Mitek Corporation, "MTX AUDIO—Complete Care Audio—2001" product catalog, published prior to the filing date of the above application, front and back cover and pp. 26 & 27 describing the RFL subwoofer. Published Phoenix, AZ, USA.

(List continued on next page.)

*Primary Examiner*—Huyen Le
(74) *Attorney, Agent, or Firm*—Mary M. Lee

(57) ABSTRACT

A speaker with a replaceable cone assembly. The motor assembly has its own basket, which is mounted in the enclosure. The cone assembly also has its own basket, which fits inside the motor basket. In the event of damage or malfunction in the cone or coil, the entire cone assembly is easily removed and replaced, while the motor assembly and the main basket remain undisturbed in the enclosure. Preferably, the speaker includes a pole with additional vents to improve heat dissipation. The pole has a pole cap with vent openings aligned with the secondary vent passages in the pole. The pole cap has a plug to occlude the front end opening of the central or primary vent passage in the pole. The top of the cap is domed to provide a guide surface for the former as the replacement cone assembly is inserted in the motor assembly.

22 Claims, 9 Drawing Sheets

OTHER PUBLICATIONS

Vance Dickason & Chris Tobin, "Alumapro Alchemy—12DVC Test Report," Car Audio and Electronics, Jan., 1999, pp. 38–39, Anaheim, CA, USA.

Steve Schlargen, "The Replacement Basket Equation," Peavey Electronics Corp. website; upon information and belief, published prior to the filing date of this application; page http://http://www.peavey.com/support/technotes/misc/blackwidow.cfm; Peavey Eelctronics Corp., Meridian, MS, USA.

Peavey Electronics Corp., "Black Widow Super Structure" Peavey Electronics Corp. website; upon information and belief, published prior to the filing date of this application; page http://www.peavey.com/media/pdf/misc/replacement_baskets.pdf; Peavey Eelctronics Corp., Meridian, MS, USA.

Peavey Electronics Corp., "Speaker Components" Peavey Electronics Corp. website; upon informatio and belief, published prior to the filing date of this application; page hhtp://www.peavey.com/support/spkrcomponents/index.cfm; Peavey Eelctronics Corp., Meridian, MS, USA.

Resonance Incorporated "DD2000a" Resonance Incorporated website; upon informatio and belief, published prior to the filing date of this application; page http://www.ddaudio.com/caraudio/woofers.asp?series=2000a; Resonance Incorporated, Oklahoma City, OK, USA.

Fugitsu Ten, Eclipse by Fujutsu Ten—2002 Mobile Entertainment Catalog (Fall), Sep. 2002, pp. 62–65 plus front and back cover (Fujitsu Ten Limited, Japan).

* cited by examiner

DUAL BASKET SPEAKER WITH REPLACEABLE, SELF-ALIGNING CONE ASSEMBLY AND SUPER VENTILATED POLE PIECE

FIELD OF THE INVENTION

The present invention relates generally to speakers and, more specifically, to speakers with replaceable cone assemblies.

BACKGROUND OF THE INVENTION

Although modem automotive speakers are relatively durable and sturdy, damage or malfunction still occurs from time to time. Subwoofers, with their long cone and coil excursions, are the most likely to experience problems. In the great majority of cases, it is the cone or coil assembly where the defect or damage occurs.

When repairing or rebuilding a speaker, the correct positioning of the replacement coil and former relative to the pole piece is critical to the ultimate performance of the repaired speaker. Because this alignment is particularly exacting, repair of speakers usually requires the return of the entire speaker to the manufacturer or dealer, where the speaker is disassembled and rebuilt, or simply replaced. This is expensive and time-consuming, compared to repair in the field. The weight of the larger subwoofers, in particular, makes shipping charges significant.

Recently, attempts have been made to provide automotive speakers with replaceable cone and coil assemblies making possible on-site repair. However, there remains a need for a speaker system with a replaceable cone assembly in which the correct alignment of the coil and former on the pole is facilitated. In addition, there remains a need for a system wherein the heavy motor and main basket need not be removed from the vehicle in order to repair or replace the cone or coil components. Still further, there is a need for a speaker system with improved heat sinking capacity in the pole. These and other advantages are provided by the speaker of the present invention.

SUMMARY OF THE INVENTION

The present invention comprises a speaker. The speaker comprises a motor assembly and a cone assembly. The motor assembly includes a motor basket having a front and a rear. The front of the motor basket has a frontal opening, and the motor basket defines a cone assembly receiving space. The motor assembly also includes a magnetically and thermally conductive pole fixed at the rear of the motor basket. The pole has a front end and a rear end. A magnet surrounds at least a portion of the pole.

The cone assembly is removably mountable in the motor basket and comprises a cone basket having a frontal opening and a cone. The cone has a central portion and a peripheral edge, the peripheral edge being supported in the frontal opening of the cone basket for axial movement. The cone assembly further comprises a coil assembly including a former and a coil. The former has a linking portion and a coil portion. The linking portion of the former is linked to the central portion of the cone to drive its axial movement. The coil portion of the former is sized and positioned to be receivable over the front end of the pole when the cone assembly is mounted in the motor assembly. The coil winding is on the coil portion of the former. Means is included for connecting the coil to an electrical source. When the cone assembly is mounted in the motor assembly, the coil portion of the former is operatively supported over the pole near the magnet so that energizing the coil will cause reciprocating motion of the former and the cone to which it is linked.

Still further, the present invention includes a speaker comprising a frame with a front and a rear. The front of the frame defines a frontal opening. Also included is a cone having a central portion and a peripheral edge, the peripheral edge being supported in the frontal opening of the frame for axial movement. The speaker further comprises a coil assembly including a former and coil. The former has a linking portion and a coil portion, and the linking portion of the former is linked to the central portion of the cone to drive its axial movement. The coil winding is supported on the coil portion of the former, and means is provided for connecting the coil to an electrical source.

The speaker further comprises a magnetically and thermally conductive pole fixed at the rear of the frame. The pole has a front end and a rear end, the front end being operatively received inside the rear portion of the former of the coil assembly. A magnet surrounds at least a portion of the pole so that energizing the coil will cause reciprocating motion of the former and the cone to which it is linked.

The pole comprises an elongate body defined by a sidewall forming a primary vent passage extending from a blind end near the front end of the pole to a rear opening at the rear end of the pole. The sidewall of the pole body further defines at least one secondary vent passage through the side wall extending from an opening at the front end of the pole a distance toward the rear end of the pole and communicating with the primary vent passage.

DETAILED DESCRIPTION OF THE PREFERRED EMBODIMENT

Figure 1:
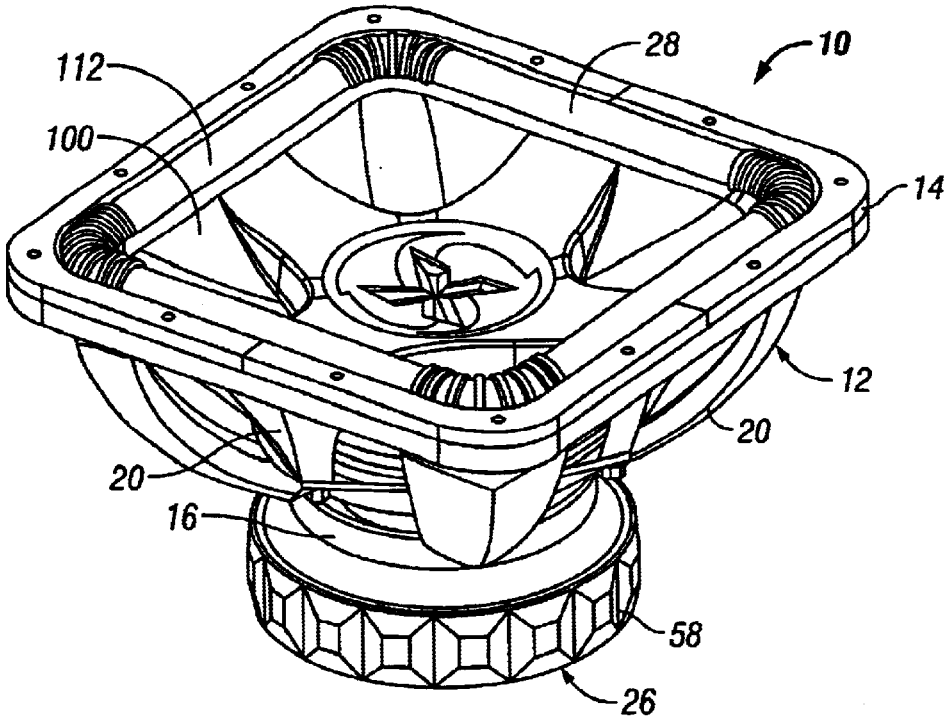
FIG. 1 is a front perspective view of a dual basket speaker constructed in accordance with the present invention.
Figure 2:
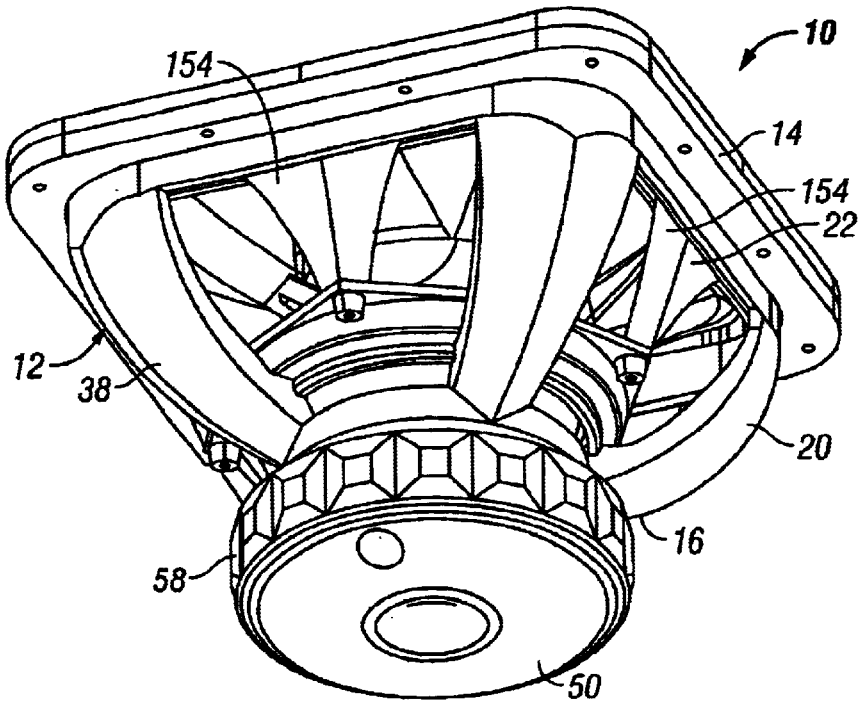
FIG. 2 is a rear perspective view of the speaker of FIG. 1.
Figure 3:
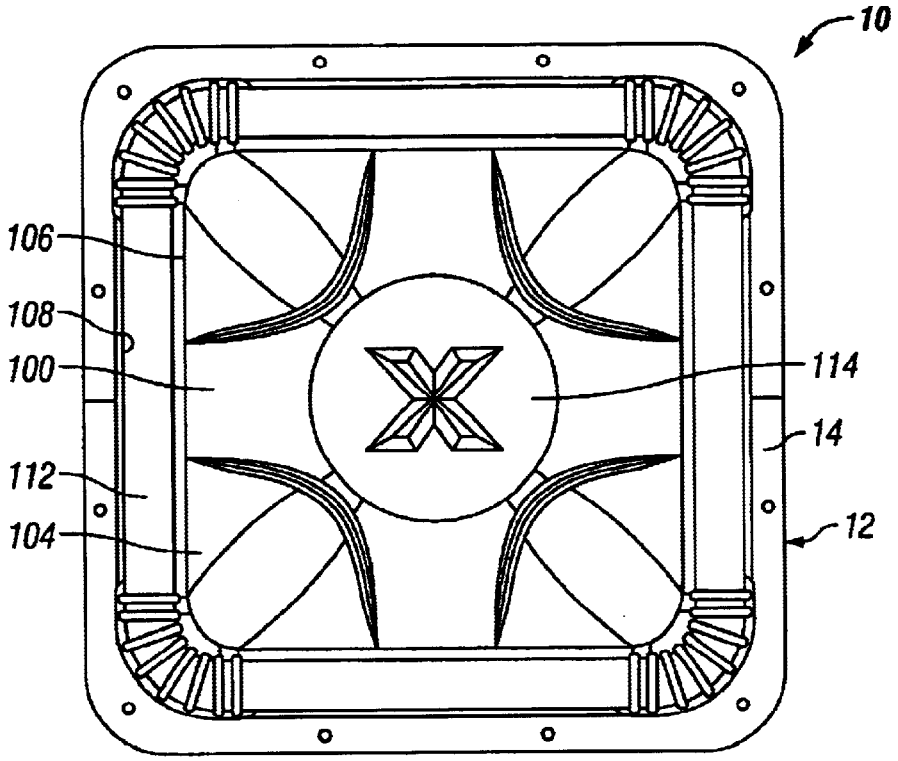
FIG. 3 is a plan view of the speaker shown in FIG. 1.
Figure 4:
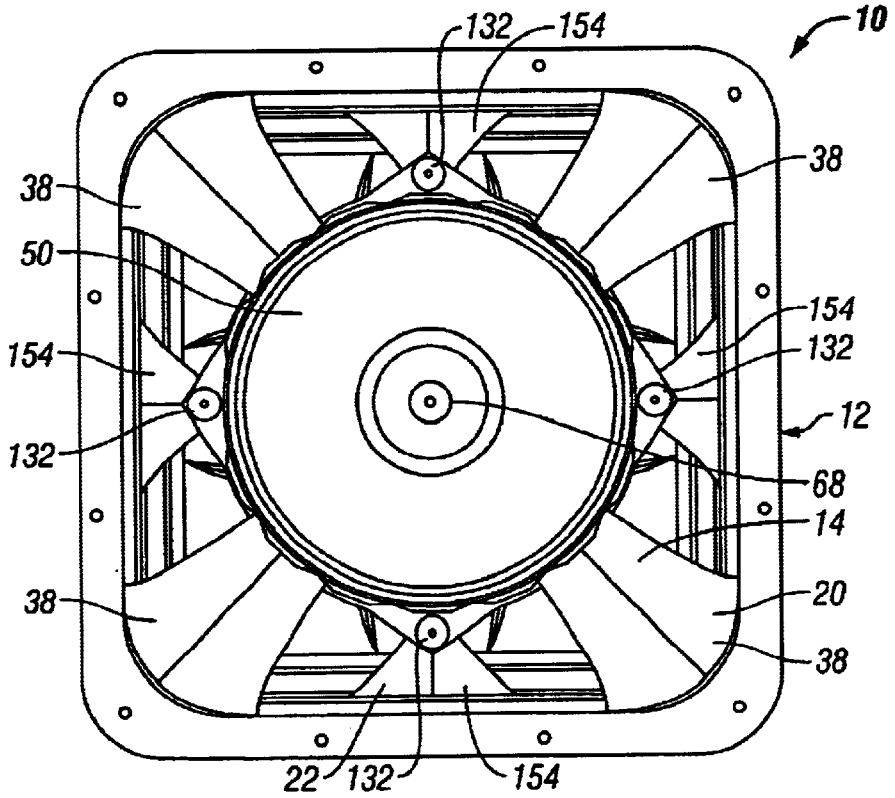
FIG. 4 is a bottom view of the speaker shown in FIG. 1.
Figure 5:
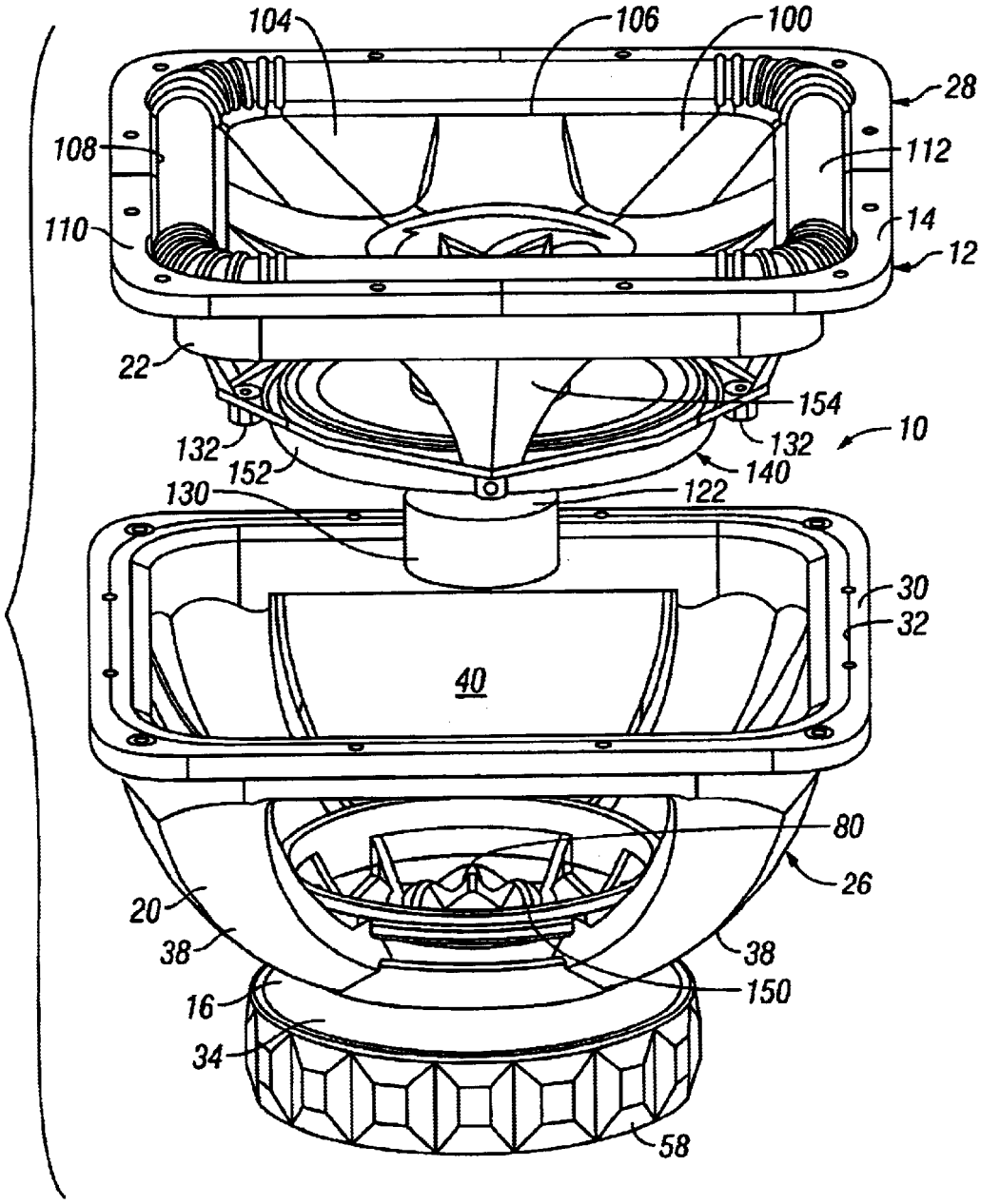
FIG. 5 is a side exploded perspective view of the speaker shown in FIG. 1.
Figure 6:
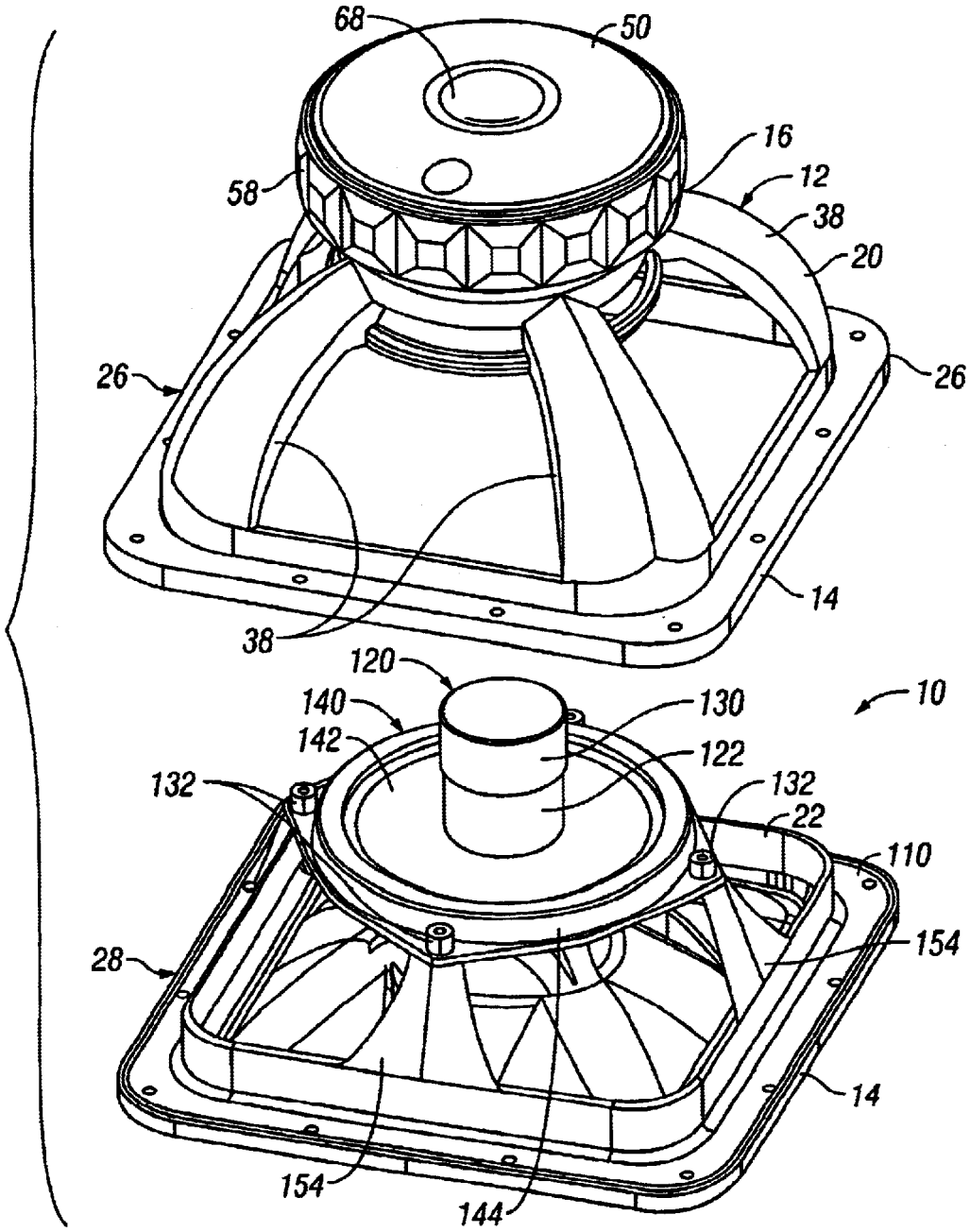
FIG. 6 is a rear exploded perspective view of the speaker shown in FIG. 1.

Turning now to the drawings in general and to FIGS. 1–4 in particular, there is shown therein a speaker constructed in accordance with the present invention and designated generally by the reference numeral 10. As used herein, "speaker" refers to the driver assembly and does not necessarily include the enclosure, which those skilled in the art will understand is essential for operation of an installed speaker. In the embodiment described herein, the speaker is a subwoofer, that is, a speaker with an ultra low frequency transducer. Moreover, the subwoofer of this embodiment is intended for installation in a vehicle such an automobile, sport utility vehicle or truck. However, the present invention is applicable to speakers generally and includes, without limitation, full range and mid-range woofers as speakers for non-automotive applications.

Figure 7:
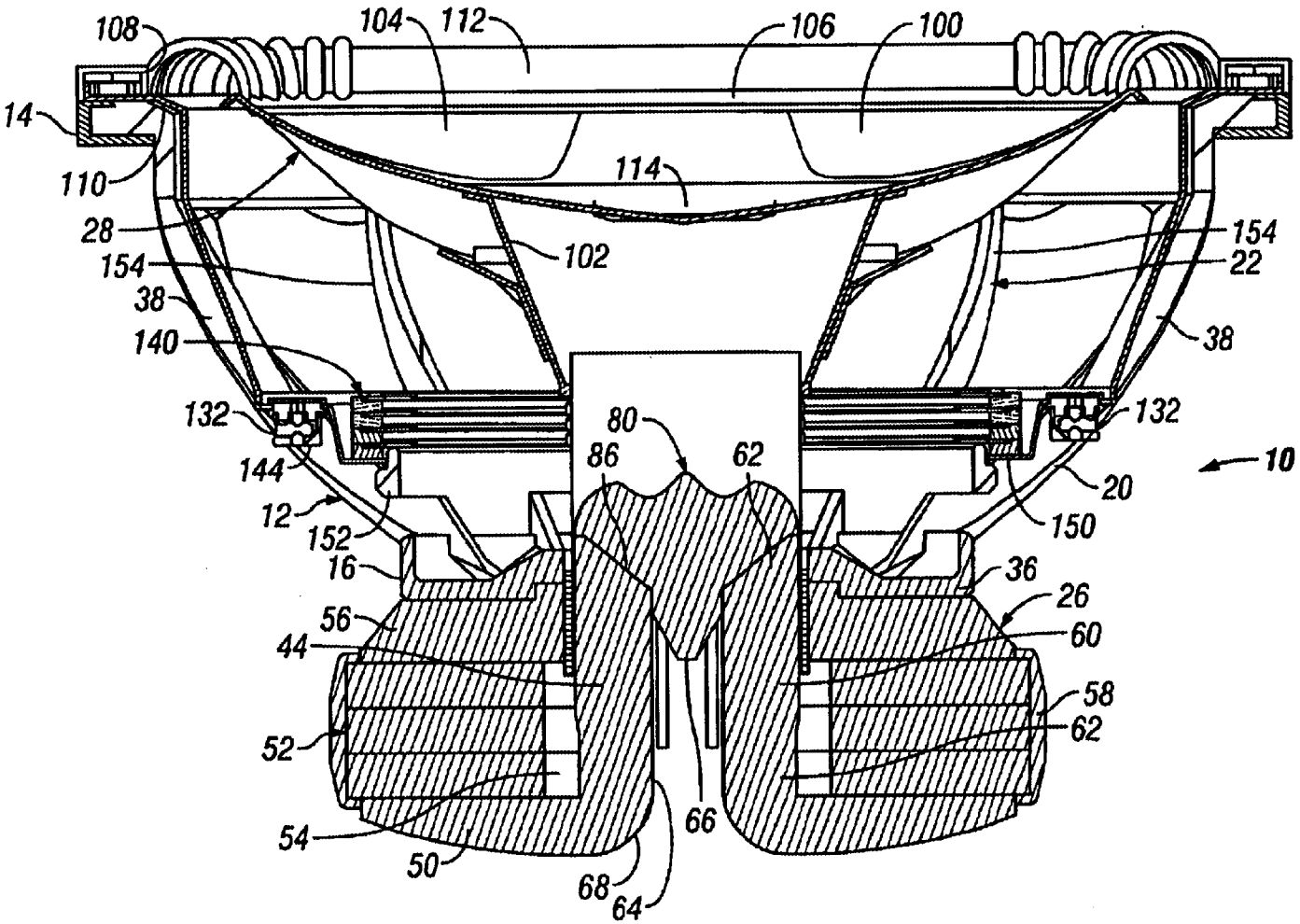
FIG. 7 is a side sectional view of the assembled speaker shown in FIG. 1.

The speaker 10 comprises a frame 12 which serves as the main support for the speaker's components. The frame 12 has a front 14 (FIG. 3) and a rear 16 (FIG. 7). As used herein, "front" refers generally to the aspect of the speaker 10 that faces outwardly in the direction sound is emitted. "Rear," as used in connection with the speaker 10, denotes the back of the speaker opposite the front.

As seen in FIGS. 5–8, the frame 12 preferably comprises motor basket 20 and a cone basket 22. The motor basket 20 supports and forms a part of the motor assembly 26. The cone basket 22 supports and forms a part of the cone assembly 28.

Figure 8:
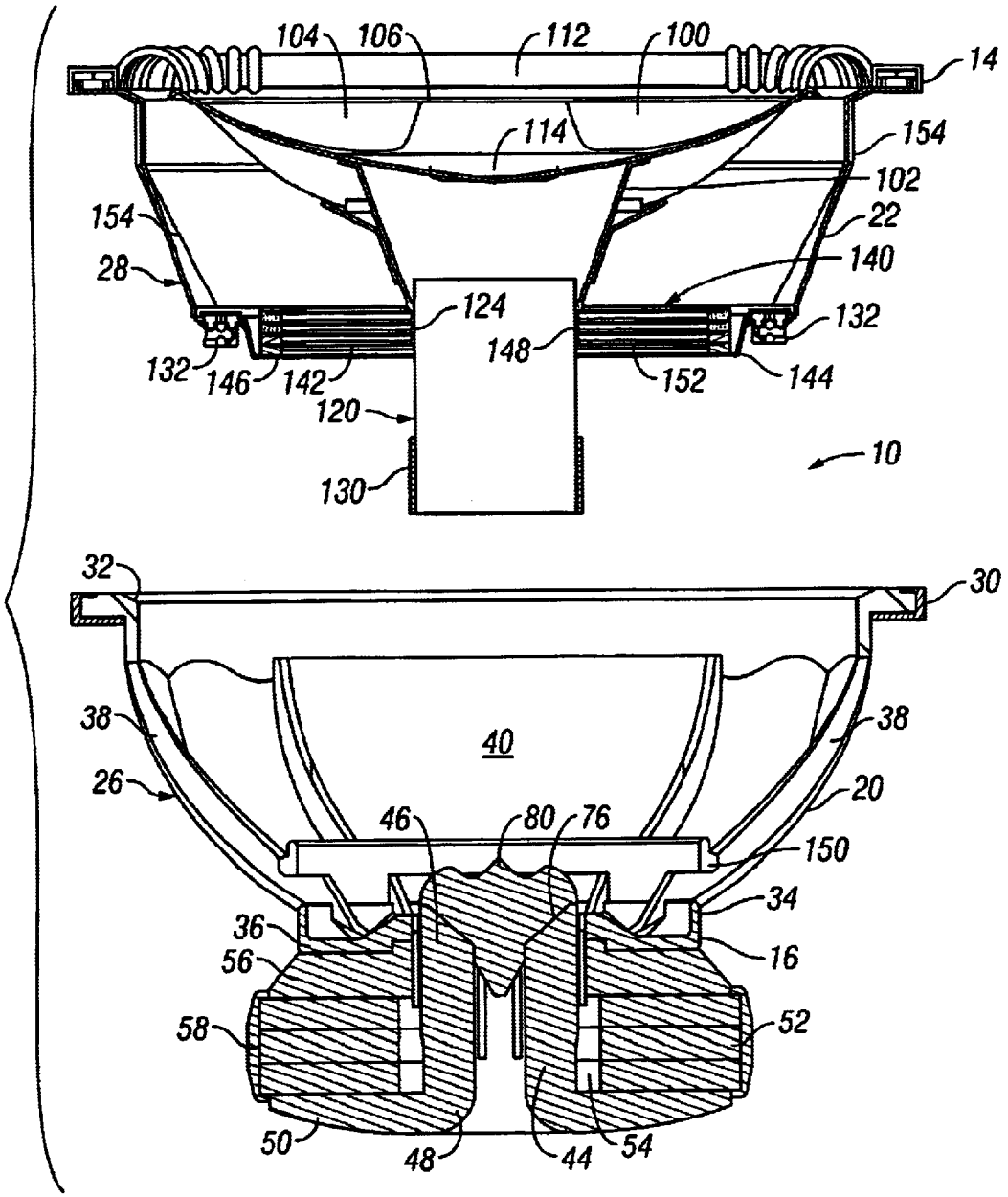
FIG. 8 is a side exploded elevational view of the speaker shown in FIG. 1.
Figure 9:
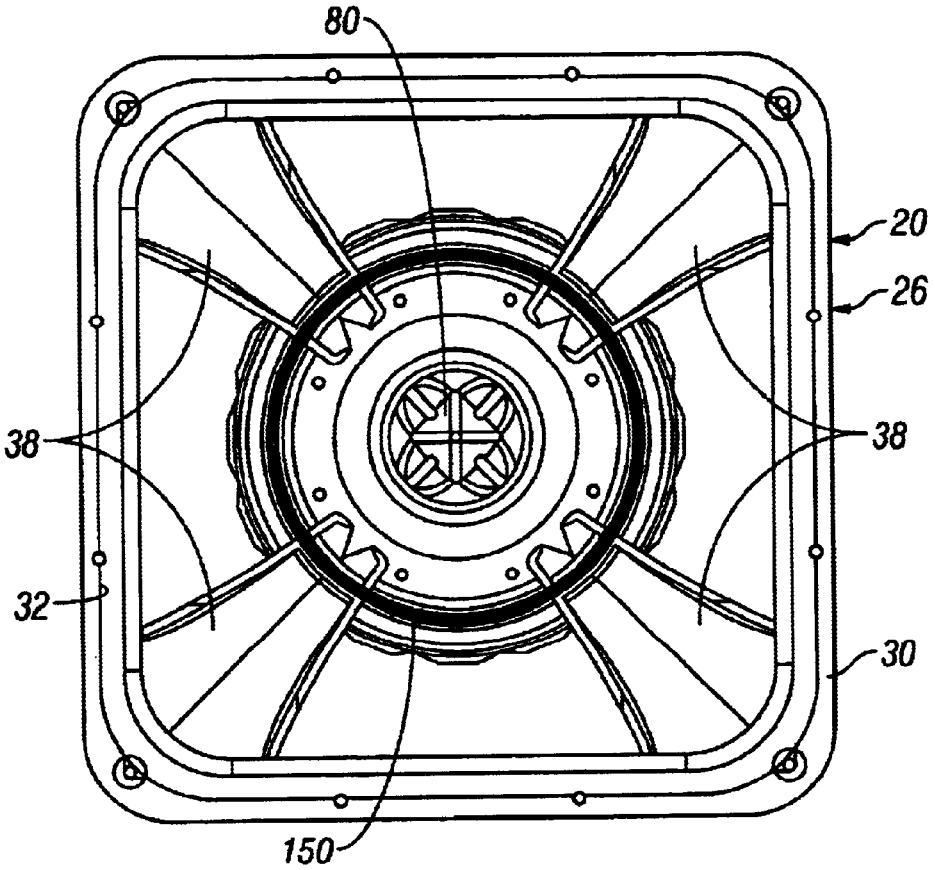
FIG. 9 is a plan view of the motor assembly of the speaker shown in FIG. 1.

The front 30 of the motor basket defines a frontal opening 32. The rear 34 of the motor basket 20 comprises an annular base 36. (FIG. 8). Extending between the front 30 and rear 34 of the motor basket 20 are a plurality of braces 38 which generally define a cone assembly receiving space 40.

In addition to the motor basket 20, the motor assembly 26 comprises a pole 44 fixed at the rear 34 of the motor basket. Preferably, the pole 44 is a cylindrical member with a front end 46 and a rear end 48. Typically, the motor assembly 26 will include a back plate 50. In the preferred embodiment, the back plate 50 and the pole 44 are integrally formed as a single member, though this is not essential. Preferably, the pole 44 is formed of a magnetically conductive and thermally conductive material, such as a low carbon steel.

A magnet 52 is provided in the motor assembly 26 surrounding at least a portion of the pole 44 and creating an air gap 54 therebetween. The magnet 52 may be either a permanent magnet or an electromagnet, but usually a permanent magnet is utilized. The magnet 52 may take many forms. In the speaker shown herein, the magnet 52 comprises a set of three annular ring magnets stacked together and supported on the back plate 50. A top plate 56 usually is included on top of the magnet 52. In this arrangement, the top plate 56, magnet 52 and back plate 50 can be secured to the bottom or rear of the annular base 36 of the motor basket 20. Any suitable form of attachment may be used, such as glue or bolts (not shown) or a combination of these. A rubber boot 58 may be secured around the outer perimeter of the magnets 52.

Referring still to FIGS. 7 and 8, and now also to FIGS. 11 and 12, the preferred construction of the pole 44 will be described in more detail. The preferred pole 44 comprises an elongate body 60 defined by a sidewall 62. The sidewall 62 defines a central bore or primary vent passage 64 extending from a blind end 66 (FIG. 7) near the front end 46 of the pole to a rear opening 68 at the rear end 48 of the pole.

The sidewall 62 of the pole 44 further defines at least one secondary vent passage and preferably comprises a plurality of secondary vent passages. More preferably, there are four vent passages 72*a–d*, as best seen in FIG. 11. The secondary vent passages 72*a–d* extend through the sidewall 62 from inside the primary vent passage 64 to outside of the pole body. Further, the secondary vent passages 72*a–d* extend from an opening at the front end 46 of the pole 44 a distance rearwardly from the front end toward the rear end 48 of the pole. This allows fluid communication, or creates a continuous air passage, from the front end 46 of the pole 44 and from the outside of the body of the pole to the interior primary vent passage 64. Preferably, the secondary vent passages 72*a–d* extend to a point in the pole 44 adjacent or near the air gap 54 between pole 44 and inner diameter of the top plate 56. This places the air passages through the pole 44 closer to the heat source, the coil assembly (described below). The secondary vent passages through the pole reduce eddy currents induced in the pole and the top plate or both.

In the present embodiment, the secondary vent passages 72*a–d* are straight, longitudinal slots. However, these passages may take many forms, such as oblique slots, helical passages, and other configurations.

Now it will be appreciated that, with the front end of the primary vent passage 64 being closed (FIGS. 7 and 8), air moving in and out through the pole 44 must pass through the secondary vent passages 72*a–d*. This allows the air to contact a greater surface area of the thermally conductive pole 44, which increases the capacity of the pole to dissipate heat generated by the coil assembly.

Figure 11:
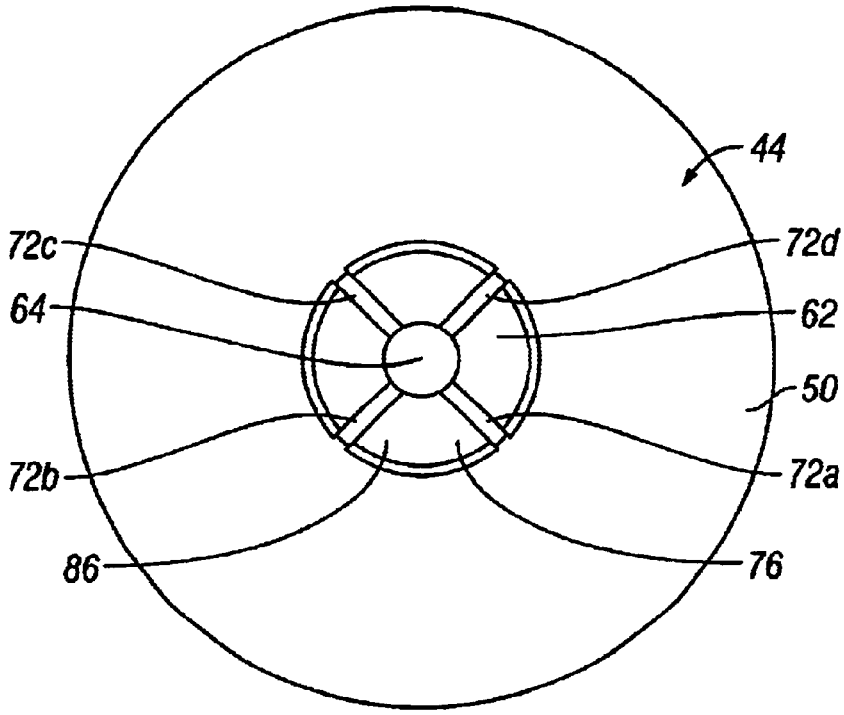
FIG. 11 is plan view of the pole piece of the speaker.
Figure 12:
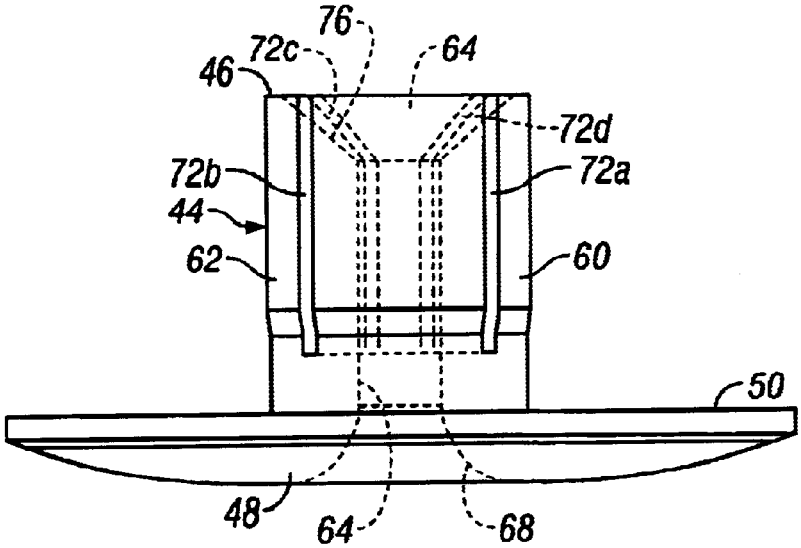
FIG. 12 is a side elevational view of the pole piece with the internal passages shown in broken lines.
Figure 13:
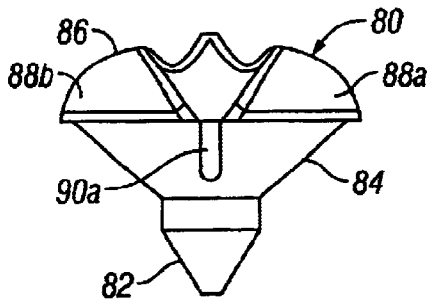
FIG. 13 is a side elevational view of the pole cap of the speaker.
Figure 14:
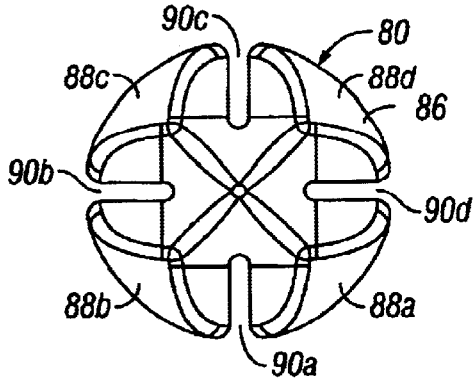
FIG. 14 is a plan view of the pole cap.
Figure 15:
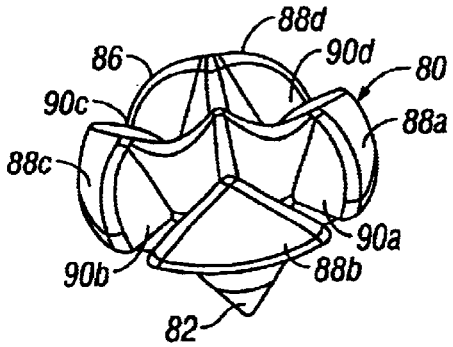
FIG. 15 is a front perspective view of the pole cap.
Figure 16:
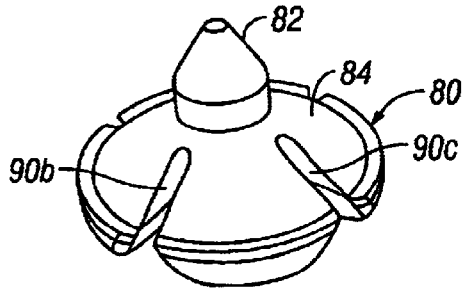
FIG. 16 is a rear perspective view of the pole cap.

Referring still to FIGS. 7, 11 and 12, the front end 46 of the pole 44 preferably is internally tapered to form conical face 76 continuous with the primary vent passage 64. However, the front end 46 may take other shapes. In this embodiment, the central or primary vent passage 64 continues through the pole 44 to an opening in the front end 46. When formed like this, the blind end 66 of the primary vent passage 62 may be created by providing a pole cap 80 with a portion formed to occlude the opening in the front end 46. To that end, the pole cap 80 is provided with a rearwardly extending plug 82 sized to be received in the primary vent passage 64. This forces the air to pass through the secondary vent passages 72*a–d*.

As shown in FIGS. 13–16, as well as FIG. 7, the preferred shape for the pole cap 80 includes a body 84 with a tapered outer wall that conforms to the shape of the conical face 76 of the pole 44. The front end 86 of the pole cap 80 is specially contoured for a reason to be described hereafter.

Preferably, the front end 86 is generally domed-shaped providing curved guide surfaces 88*a–d* gently sloping from the top of the front end toward the periphery of the front end. Where the pole 44 comprises secondary vent passages 72*a–d* opening on the front end 46 of the pole, corresponding vent openings 90*a–d* are provided in the domed front end 86.

The pole cap 80 can be formed of various materials. It is advisable to form the pole cap 80 of a non-magnetic material so as not to interfere with the magnetic flux lines generated by the nearby coil assembly (described below) and magnet 52. However, it is advantageous to form the pole cap 80 of thermally conductive material to provide additional heat sinking capacity. One preferred material for the pole cap is aluminum. The pole cap 80 may be affixed to the front end 46 of the pole 44 in any suitable manner. For example, the pole cap 80 may be glued using a thermally conductive, high temperature epoxy.

With continuing reference to FIGS. 5–8, the cone assembly 28 will now be described in more detail. The cone assembly 28 comprises a diaphragm or cone 100. The cone 100 preferably is concaved or contoured inwardly; however, it may be flat or otherwise shaped. In this embodiment, the cone comprises a central portion, such as a cone neck 102, from which extends a cone skirt 104 with a peripheral edge 106. The peripheral edge 106 is supported in the front opening 108 at the front end 110 of the cone basket 22.

In most instances, it will be desirable to make the cone as rigid as possible to ensure accurate reproduction of the sound. The rigidity may be provided by the character of the material itself, by contouring the material into struts, by including a supportive brace or reinforcing member of some sort, by some combination of these features, or by other means.

The peripheral edge 106 of the cone 100 is supported in the frontal opening for reciprocating axial movement. Preferably, the edge 106 is fixed to a flexible surround 112, which is in turn fixed to the frontal opening 108. In the preferred embodiment, the surround 112 is convex.

A dust cap 114 may be provided to cover the top of the cone neck 102. In the embodiment illustrated, a logo "X" is formed into the dust cap 114. This is ornamental only, and does not contribute to the function of the speaker 10.

In the embodiment illustrated herein, the general configuration of the peripheral edge 106 of the cone 100 and the frontal openings 32 and 108 and of the motor basket 29 and the cone basket 22, respectively, is square. When this is the case, or whenever the configuration of the speaker is polygonal (having multiple straight sides), as opposed to oval or circular, it is preferable to provide each corner of the surround 112 with pleats indicated generally at 114. Such a surround is described in more detail in U.S. patent application Ser. No. 09/610,600, file Jul. 5, 2002, entitled "Ultra Low Frequency Transducer and Speaker Comprising Same," the contents of which are incorporated herein by reference. It will be noted, however, that the present invention is equally applicable to round or circular speakers, or to speakers with cones of virtually any shape.

Referring still to FIGS. 5–8, the cone assembly 28 includes a coil assembly 120. Typically, the coil assembly 120 will comprise a former 122 having a linking portion 124 and a coil portion 126. In a known manner, a coil winding 130 is supported on the coil portion 126 of the former 122, and these coils are electrically connectable to an electrical source by wires (not shown) and terminals 132. The coil 130 may be a single, double or multiple coils. The linking portion 124 of the former 122 is linked to the central portion or the cone neck 102 of the cone 100 to drive its reciprocating axial movement.

The internal diameter of the former 122 is sized to operatively receive the front end 46 of the pole 44. In this way, when the former 122 is properly positioned over the pole 44, near the magnet 52, energizing the coil 130 will cause reciprocating axial motion of the former, and the cone 100 to which it is linked.

The cone assembly 28 preferably also includes a spider assembly 140 which may include one or more spiders 142, usually layered. The cone basket 22 is formed with an annular spider mounting ring 144 to which the outer diameter 146 of the spider assembly 140 is fixed. The inner diameter 148 of the spider assembly 140 is fixed to the former by adhesive, or in some other suitable manner, so that the spider assembly 140 maintains the correct alignment of the former 122 as it reciprocates on the pole 44.

Figure 10:
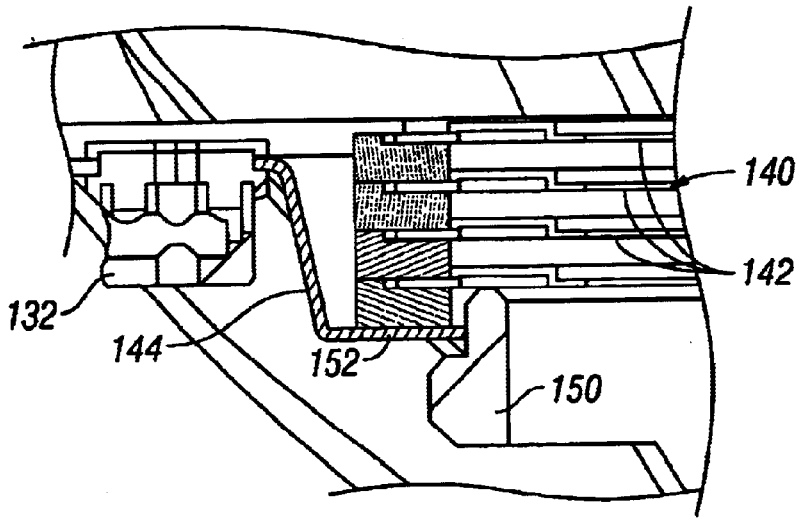
FIG. 10 is an enlarged sectional view through a portion of the speaker illustrating one of the self-aligning structures.

With continued reference to FIG. 7 and now also to FIG. 10, the cone assembly 28 preferably comprises a cone assembly alignment member 150, and this can be provided conveniently on the spider support ring 144. In a preferred form, the cone assembly alignment member 150 comprises an annular edge depending from the spider mounting ring 144.

The motor assembly 26 preferably will include a motor assembly alignment member 152 is shaped and positioned to engage the cone assembly alignment member 150. The motor assembly alignment member 152 may conveniently be formed as part of the motor basket 20 as an annular shoulder slightly above the base 36.

The spider mounting ring 144 preferably will be externally supported relative to the front end 110 of the cone basket 22. For this purposes, a plurality of braces 154 may be provided.

Now it will be apparent that, in the speaker 10 of the present invention, the cone assembly 28 and motor assembly 26 are formed so that the cone basket 22 is receivable in the motor basket 20, preferably in a nesting fashion. As the cone basket 22 is inserted into the cone assembly receiving space 40 of the motor basket 20, alignment of the coil portion 126 of the former 122 over the pole 46 will be facilitated because of the engagement between the cone assembly alignment member 150 and the motor assembly alignment member 152.

Now another advantageous feature of the speaker 10 will become apparent. As the cone assembly 28 is inserted into the motor basket 20, the former 122 will be directed toward the pole cap 80. The inner diameter of the former 122 will engage and slide down over the guide surfaces 88*a–d* of the domed front end 86 of the pole cap 80. This ensures that there will be no damage to the coil 130 as the former 122 is placed into the air gap 54, and further ensures the mating engagement of the cone assembly and motor assembly alignment members 150 and 152.

It will be appreciated that the speaker of the present invention offers numerous advantages. The dual basket design allows the cone assembly, with its supporting basket, to be removed from an installed speaker without removing or otherwise disturbing the heavy motor assembly. This allows replacement of a damaged or defective cone or coil while the motor assembly remains mounted in the enclosure in the vehicle. Still further, the self-aligning features, including the domed pole cap and the mating alignment edges of the motor and cone baskets, ensure that the former will be easily inserted and precisely aligned without damage to the coil in the process. Shipping charges associated with return of the defective or damage cone or coil are greatly reduced, as the weight of the cone assembly is substantially less that the weight of the entire speaker including a heavy motor assembly.

The secondary vent passages in the "super ventilated" pole, coupled with the occluded front end opening of the main vent passage, improves the heat sinking capacity in the speaker. More surface area of the thermally conductive pole contacts the air, and the passages are close to the source of the heat—the coil assembly. The thermally conductive pole cap with its contoured front end, in addition to funneling air into the secondary air passages in the pole, provides additional mass for heat dissipation and reduces turbulence as the air rushes into the secondary vent passages in the pole.

Changes can be made in the combination and arrangement of the various parts and steps described herein without departing from the spirit and scope of the invention.

What is claimed is:

1. A speaker comprising:

a motor assembly comprising:

a motor basket having a front and a rear, wherein the front includes a frontal opening, and wherein the motor basket defines a cone assembly receiving space;

a magnetically and thermally conductive pole fixed at the rear of the motor basket, the pole having a front end and a rear end; and a magnet surrounding at least a portion of the pole; and a cone assembly removably mountable in the motor basket comprising:

a cone basket having a frontal opening;

a cone having a central portion and a peripheral edge, the peripheral edge being supported in the frontal opening of the cone basket for axial movement; and a coil assembly comprising:

a former having a linking portion and a coil portion, wherein the linking portion of the former is linked to the central portion of the cone to drive its axial movement, wherein the coil portion of the former is sized and positioned to be receivable over the front end of the pole when the cone assembly is mounted in the motor assembly;

a coil winding on the coil portion of the former; and means for connecting the coil to an electrical source;

whereby when the cone assembly is mounted in the motor assembly, the coil portion of the former is operatively supported over the pole near the magnet so that energizing the coil will cause reciprocating motion of the former and the cone to which it is linked.

2. The speaker of claim 1 wherein the motor assembly further comprises a top plate and bottom plate, and wherein the magnet is secured between the top plate and the bottom plate.

3. The speaker of claim 1 wherein the cone is rigid and wherein the cone assembly includes a flexible surround for supporting the peripheral edge of the cone in the frontal opening of the cone basket.

4. The speaker of claim 1 wherein the cone comprises a cone neck and a cone skirt extending between the cone neck and the peripheral edge, and wherein the linking portion of the former is attached to the cone neck.

5. The speaker of claim 1 wherein the cone assembly comprises a spider assembly having a inner diameter and an outer diameter, wherein the cone basket includes a spider mounting ring for attaching to the outer diameter of the spider assembly, and wherein the inner diameter of the spider assembly is fixed to the former.

6. The speaker of claim 5 wherein the spider mounting ring has a cone assembly alignment member and wherein the motor basket has a motor assembly alignment member adapted to engage the cone assembly alignment member on the spider mounting ring to ensure alignment of the former when the cone assembly is mounted in the motor assembly.

7. The speaker of claim 1 wherein the wherein the pole comprises an elongate body defined by a sidewall forming a primary vent passage extending from a blind end near the front end of the pole to a rear opening at the rear end of the pole, and wherein the sidewall of the pole body further defines at least one secondary vent passage through the side wall extending from an opening at the front end of the pole a distance toward the rear end of the pole and communicating with the primary vent passage.

8. The speaker of claim 7 wherein the at least one secondary vent passage comprises a plurality of secondary vent passages.

9. The speaker of claim 8 wherein the each of the plurality of secondary vent passages is a straight, longitudinal slot.

10. The speaker of claim 7 wherein the primary vent passage extends from an opening in the front end of the pole, wherein the motor assembly further comprises a pole cap, and wherein the pole cap comprises a plug received in the opening of the primary vent passage in the front end of the pole so that air passing through the primary vent passage is forced through the at least one secondary vent passage.

11. The speaker of claim 10 wherein the pole cap further comprises a dome sized to fit on the front end of the pole, wherein the pole cap has at least one vent opening corresponding to the at least one secondary vent passages in the pole.

12. The speaker of claim 11 wherein the pole cap is formed of material that is thermally conductive but non-magnetically conductive.

13. The speaker of claim 11 wherein the dome has frontal surface that is curved to form a guide surface for the former as the cone assembly is inserted into the motor assembly.

14. The speaker of claim 13 wherein the cone assembly comprises a spider assembly having a inner diameter and an outer diameter, wherein the cone basket includes a spider mounting ring for attaching to the outer diameter of the spider assembly, and wherein the inner diameter of the spider assembly is fixed to the former.

15. The speaker of claim 14 wherein the cone assembly has a cone assembly alignment member and wherein the motor basket has a motor assembly alignment member adapted to engage the cone assembly alignment member to ensure alignment of the former when the cone assembly is mounted in the motor assembly.

16. A speaker comprising:

a frame having a front and a rear, the front defining a frontal opening;

a cone having a central portion and a peripheral edge, the peripheral edge being supported in the frontal opening of the frame for axial movement;

a coil assembly comprising:

former having a linking portion and a coil portion, wherein the linking portion of the former is linked to the central portion of the cone to drive its axial movement;

a coil winding on the coil portion of the former; and means for connecting the coil to an electrical source;

a magnetically and thermally conductive pole fixed at the rear of the frame, the pole having a front end and a rear end, the front end operatively received inside the rear portion of the former of the coil assembly;

a magnet surrounding at least a portion of the pole whereby energizing the coil will cause reciprocating motion of the former and the cone to which it is linked;

wherein the pole comprises an elongate body defined by a sidewall forming a primary vent passage extending from a blind end near the front end of the pole to a rear opening at the rear end of the pole;

wherein the sidewall of the pole body further defines at least one secondary vent passage through the side wall extending from an opening at the front end of the pole a distance toward the rear end of the pole and communicating with the primary vent passage.

17. The speaker of claim 16 wherein the at least one secondary vent passage comprises a plurality of secondary vent passages.

18. The speaker of claim 17 wherein the each of the plurality of secondary vent passages is a straight, longitudinal slot.

19. The speaker of claim 16 wherein the at least one secondary vent passage is a straight, longitudinal slot.

20. The speaker of claim 16 wherein the primary vent passage extends from an opening in the front end of the pole, wherein the speaker further comprises a pole cap, and wherein the pole cap comprises a plug received in the opening of the primary vent passage in the front end of the pole so that air passing through the primary vent passage is forced through the at least one secondary vent passage.

21. The speaker of claim 20 wherein the pole cap further comprises a dome sized to fit on the front end of the pole, wherein the pole cap has at least one vent opening corresponding to the at least one secondary vent passage in the pole.

22. The speaker of claim 21 wherein the pole cap is formed of material that is thermally conductive but non-magnetically conductive.

* * * * *